US006220068B1

(12) United States Patent
Brüstle et al.

(10) Patent No.: US 6,220,068 B1
(45) Date of Patent: Apr. 24, 2001

(54) PROCESS AND DEVICE FOR REDUCING THE EDGE DROP OF A LAMINATED STRIP

(75) Inventors: Roland Brüstle, Neunkirchen; Eckhard Wilke, Marloffstein, both of (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 09/202,456

(22) PCT Filed: Jun. 17, 1997

(86) PCT No.: PCT/DE97/01233

§ 371 Date: Dec. 15, 1998

§ 102(e) Date: Dec. 15, 1998

(87) PCT Pub. No.: WO97/49506

PCT Pub. Date: Dec. 31, 1997

(30) Foreign Application Priority Data

Jun. 26, 1996 (DE) ..... 196 25 442

(51) Int. Cl.[7] ..... B21B 37/00

(52) U.S. Cl. ..... 72/9.3; 72/11.8; 72/11.9; 72/365.2

(58) Field of Search ..... 72/7.1, 7.2, 8.6, 72/8.7, 9.1, 11.4, 11.7, 11.8, 12.3, 201, 234, 247, 365.2, 9.2, 9.3, 11.9

(56) References Cited

U.S. PATENT DOCUMENTS

| | | | | |
|---|---|---|---|---|
| 4,633,692 | | 1/1987 | Watanabe . | |
| 5,231,858 | * | 8/1993 | Yamashita et al. | 72/234 |
| 5,651,281 | * | 7/1997 | Seidel | 72/201 |
| 5,875,663 | * | 3/1999 | Tateno et al. | 72/11.8 |

FOREIGN PATENT DOCUMENTS

| | | |
|---|---|---|
| 43 38 615 | 5/1995 | (DE) . |
| 195 03 363 | 9/1995 | (DE) . |
| 61-095710 | 5/1986 | (JP) . |
| 62-219205 | 8/1987 | (JP) . |
| 40041010 | 2/1992 | (JP) . |
| 5-015911 | 1/1993 | (JP) . |
| 8-057515 | 3/1996 | (JP) . |
| 8-155517 | 6/1996 | (JP) . |
| WO 95/34388 | 12/1995 | (WO) . |

OTHER PUBLICATIONS

S. Wilmotte et al., "New approach to computer setup of the hot strip mill," Iron and Steel Engineer, Sep. 1977, pp. 70–76.

A. Adachi et al., "Crown reduction on hot strip rolling by taper crown rolls," Iron and Steel Engineer, Jun. 1991, pp. 43–49.

H. Yamamoto et al., "Development of Accurate Control Techniques of Strip Shape and Edge–drop in Cold Rolling," Journal of the Iron and Steel Institute of Japan, No. 3, Vol. 79, Jan. 1993, pp. 156–162.

J. Van Roey et al., "Accurate profile and flatness control on a modernized hot strip mill," Iron and Steel Engineer, No. 2, vol. 73, Feb. 1996, pp. 29–33.

H. Hartmann et al., "Ensurance of the strip shape in flat rolling, " New Foundry, vol. 3, Mar. 1991, pp. 89–94.

* cited by examiner

*Primary Examiner*—Ed Tolan

(57) ABSTRACT

The invention relates to a method for reducing the edge drop of a rolled strip in a roll train having one or more roll stands, at least one roll stand having actuators for reducing the edge drop, which are set as a function of the edge drop of the rolled strip running out of the roll stand and, if appropriate, of the edge drop of the rolled strip running into the roll stand, the edge drop being measured with at least one edge drop measuring device, and the values of the edge drop of the rolled strip being determined using a roll gap model, in order to set the actuators for reducing the edge drop at those points on the rolled strip at which the edge drop is not measured.

42 Claims, 4 Drawing Sheets

PROCESS AND DEVICE FOR REDUCING THE EDGE DROP OF A LAMINATED STRIP

FIELD OF THE INVENTION

The present invention relates to a method and device for reducing the edge drop of a rolled strip in a roll train.

BACKGROUND INFORMATION

During the rolling of metal strips, because of the mechanical properties of roll stands and the flow properties of the rolled metal, so-called edge drop occurs, i.e., a flattening of the rolled strip at the edges. It is known e.g., from Japanese Patent Application No. 08 155 517 and from article "development of accurate control techniques of strip shop and edge-drop in cold rolling," Journal of the Iron and Steel Industry of Japan, Vol. 79, No. 3, 1993, pp. 388–94, to counteract the edge drop by means of so-called tapered rolls. To this end, the working rolls are curved in a suitable way. For a particularly precise driving of the so-called tapered rolls, the edge drop is measured upstream and downstream of the appropriate roll stand. However, these measurements are expensive, in particular when they have to be carried out for a plurality of roll stands. A further problem in the known method for reducing the edge drop is that the measures for reducing the edge drop must not lead to an impermissibly high tension in the edge region of the rolled strip nor to wavy edges. If the permissible tension in the edge region of the rolled strip is exceeded, then this can lead to an impermissible reduction in the quality of the rolled strip. In order to avoid this, in the case of the conventional method for reducing the edge drop, according to Japanese Patent Application No. 62 192 205, provision is made to measure the strip tension in the edge region of the rolled strip.

SUMMARY OF THE INVENTION

An object of the present invention is to provide method and device for circumventing the abovementioned disadvantages.

According to the present invention, measuring device for measuring the edge drop is dispensed with. Furthermore, using the roll gap model it is possible to calculate the tension relationships in the roll strip, that an expensive measurement of the tension relationships for monitoring is not necessary. In addition, the method according to the present invention can advantageously be combined with flatness regulation or flatness control. The roll gap model moreover permits the edge drop to be calculated in advance, so that if appropriate necessary presettings can be made.

DETAILED DESCRIPTION OF THE INVENTION

Figure 1:
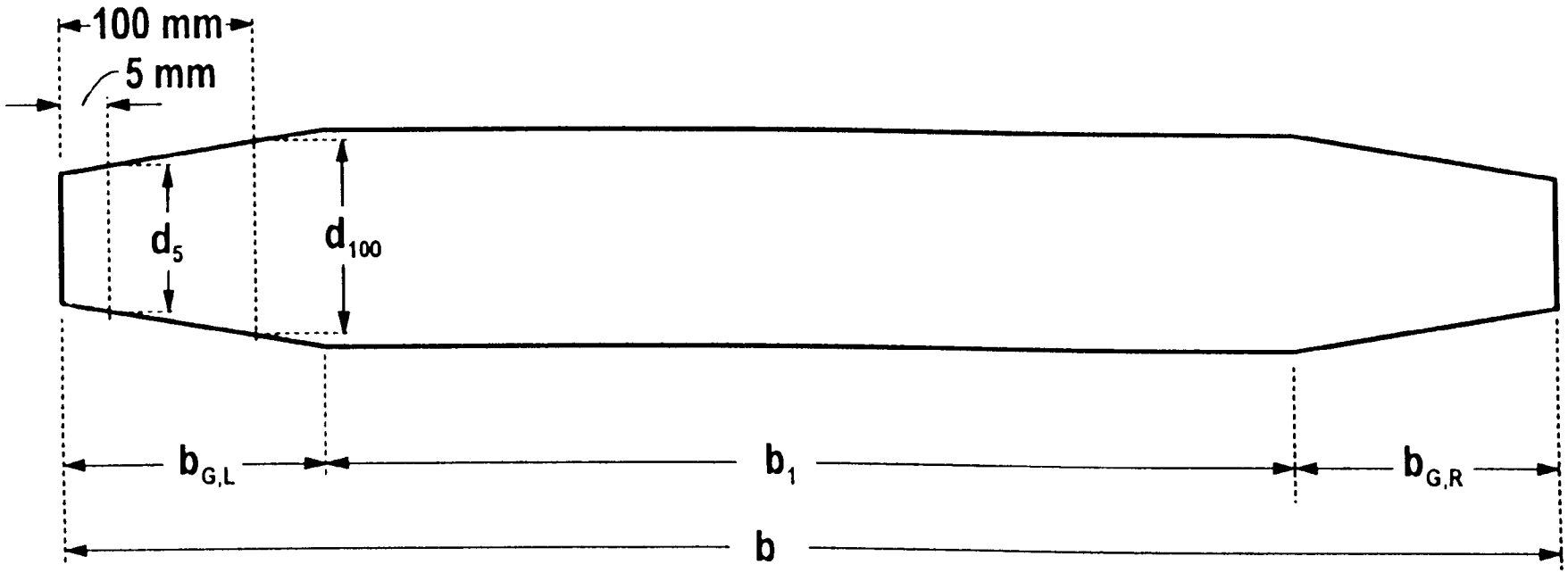
FIG. 1 shows a cross-section of a rolled strip.

FIG. 1 shows the cross-section of a rolled strip with edge drop. In this case, b designates the width of rolled strip $b_1$ the region of the rolled strip which is free of edge drop and $b_{G,L}$ and $b_{G,R}$ the edge region of the rolled strip having edge drop.

Furthermore, $d_5$, designates the thickness of the rolled strip at a distance of 5 mm from the edge of the rolled strip, and $d_{100}$ the thickness of the rolled strip at a distance of 100 mm from the edge of the rolled strip. These two values are included in one possible definition for edge drop P, if this is expressed by a numerical value. This possible definition is:

$$p = \frac{d_{100} - d_5}{d_{100}} \cdot 100\%$$

However, the edge drop can also be represented as a contour, i.e., as a function over the strip width. This representation advantageously forms the basis of the method according to the present invention for reducing the edge drop of a rolled strip.

Figure 2:
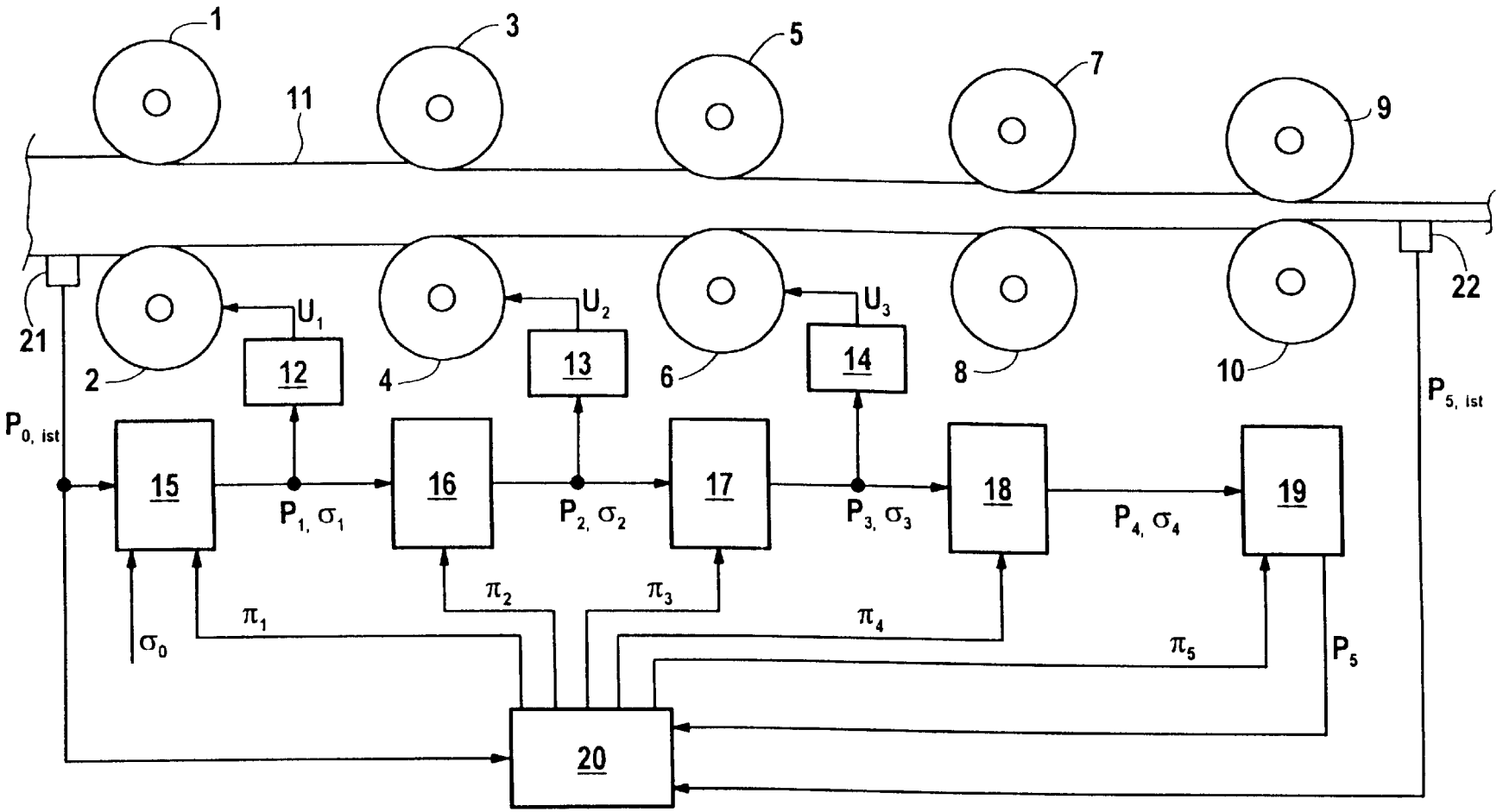
FIG. 2 shows a block diagram of a method for reducing an edge drop of a rolled strip according to the present invention.

FIG. 2 shows an exemplary application of the method according to the present invention for reducing the edge drop of a rolled strip 11. Rolled strip 11 is rolled by means of five roll stands, a first roll stand indicated by rolls 1 and 2, a second roll stand indicated by rolls 3 and 4, a third roll stand indicated by rolls 5 and 6, a fourth roll stand indicated by rolls 7 and 8 and a fifth roll stand indicated by rolls 9 and 10. The five roll-stands are part of a five-stand or multi-stand roll train. The first, second and third roll stand have actuators 12, 13, 14, with which the edge drop of rolled strip 11 can be influenced. Input variables for actuators 12, 13 and 14 are the values for edge drop $P_1$, $P_2$ and $P_3$. Since the system has only two items of measuring device 21 and 22 for measuring the edge drop upstream of the first and downstream of the fifth roll stand, the edge drops downstream of first roll stand $P_1$, downstream of second roll stand $P_2$ and downstream of third roll stand $P_3$ are determined using a roll gap model. This model has five partial models 15, 16, 17, 18, 19, which are each assigned to one roll stand. Partial model 15 is assigned to the first roll stand, partial model 16 to the second roll stand, partial model 17 to the third roll stand, partial model 18 to the fourth roll stand and partial model 19 to the fifth roll stand. Output variables of partial model 15 are edge drop $P_1$, and tension relationships $\sigma_1$, in or downstream of the first roll stand, which are in turn input variables of partial model 16. Output variables of partial model 16 are edge drop $P_2$ and tension relationships $\sigma_2$ in or downstream of the second roll stand, which are in turn input variables of partial model 17. Output variables of partial model 17 are edge drop $P_3$ and tension relationships $\sigma_3$ in or downstream of the third roll stand, which are in turn input variables of partial model 18. Output variables of partial model 18 are edge drop $P_4$ and tension relationships $\sigma_4$ in or downstream of the fourth roll stand, which are in turn input variables of partial model 19. output variables of partial model 19 are edge drop $P_5$ and tension relationships $\sigma_5$ in or downstream of the fifth roll stand. Tension relationships $\sigma_1$, $\sigma_2$, $\sigma_3$, $\sigma_4$, and $\sigma_5$ are to be understood as the web tension (flatness) and/or the tension of the rolled strip directly before entering the roll gap or directly after exiting from the roll gap.

Input variables of first partial model 15 are edge drop P0 upstream of the first roll stand and, if appropriate, tension relationships $\sigma_0$ upstream of the first roll stand. Tension relationships $\sigma_0$ upstream of the first roll stand are then included in partial model 15 when the rolled strip is, for example, uncoiled from a coil. Further input variables of partial models 15, 16, 17, 18, 19 are the roll contours for the individual roll stands. These input variables are not shown in FIG. 1. The roll contour is advantageously calculated in a roll contour model which, inter alia, comprises a temperature model, a wear model and a bending model. in this case there is advantageously an individual roll contour model for each roll stand.

During the rolling of rolled strip 11, partial models 15, 16, 17, 18, 19 are continuously adapted to the actual relationships in the roll stands using an adaptation 20, which determines appropriate parameters $\pi_1$, $\pi_2$, $\pi_3$, $\pi_4$ and $\pi_5$, for corresponding partial models 15, 16, 17, 18, 19 from the edge drop upstream of first roll stand $P_{0,\ ist}$, from edge drop $P_5$ determined by partial model 19 downstream of the fifth roll stand, and from the actual value of edge drop $P_{5,\ ist}$ downstream of the fifth roll stand.

Figure 3:
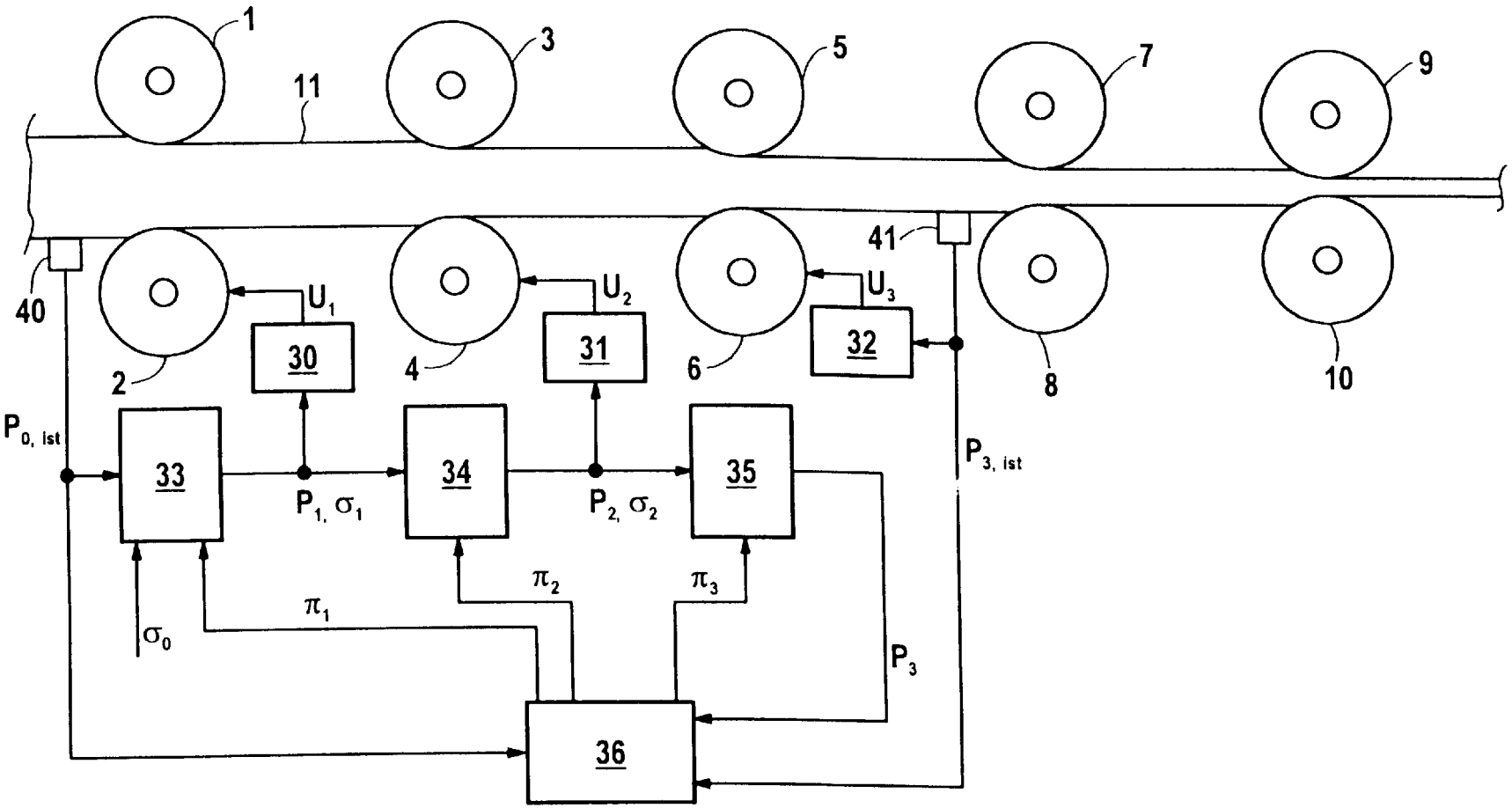
FIG. 3 shows another block diagram of the method according to the present invention for reducing the edge drop of the rolled strip.

FIG. 3 shows an exemplary application of the method according to the present invention for reducing the edge drop of a rolled strip 11. Rolled strip 11 is rolled using five roll stands, a first roll stand indicated by rolls 1 and 2, a second roll stand indicated by rolls 3 and 4, a third roll stand indicated by rolls 5 and 6, a fourth roll stand indicated by rolls 7 and 8 and a fifth roll stand indicated by rolls 9 and 10. The five roll stands are part of a five-stand or multi-stand roll train. The first, second and third roll stands have actuators 30, 31, 32 with which the edge drop of rolled strip 11 can be influenced. input variables of actuators 30, 31 and 32 are the values for edge drop $P_1$, $P_2$ and $P_{3,\ ist}$. Since the system has only two items of measuring device 40 and 41 for measuring the edge drop upstream of the first and downstream of the third roll stand, the edge drops downstream of first roll stand $P_1$, downstream of second roll stand $P_2$ and downstream of third roll stand $P_3$ are determined by means of a roll gap model. This model has three partial models 33, 34 and 35, each of which is assigned to one roll stand. Partial model 33 is assigned to the first roll stand, partial model 34 to the second roll stand and partial model 35 to the third roll stand. output variables of partial model 33 are edge drop $P_1$, and tension relationships $\sigma_1$, in or downstream of the first roll stand, which are in turn input variables of partial model 34. output variables of partial model 34 are edge drop $P_2$ and tension relationships $\sigma_2$ in or downstream of the second roll stand, which are in turn input variables of partial model 35. output variables of partial model 35 are edge drop $P_3$ and , if appropriate, tension relationships $\sigma_3$ in or downstream of the third roll stand.

Input variables of first partial model 33 are edge drop $P_{0,\ ist}$ upstream of the first roll stand and, if appropriate, tension relationships $\sigma_0$ upstream of the first roll stand. Tension relationships $\sigma_0$ upstream of the first roll stand are then included in partial model 35 when the rolled strip is, for example, uncoiled from a coil. Further input variables of partial models 33, 34 and 35 are the roll contours for the individual roll stands. These input variables are not shown in FIG. 3. The roll contour is advantageously calculated in a roll contour model which, inter alia, comprises a temperature model, a wear model and a bending model in this case there is advantageously an individual roll contour model for each roll stand.

During the rolling of rolled strip 11, partial models 33, 34 and 35 are continuously adapted to the actual relationships in the roll stands by means of an adaptation 36, which determines appropriate parameters $\pi_1$, $\pi_2$, and $\pi_3$ for corresponding partial models 33, 34 and 35 from the edge drop upstream of first roll stand $P_{0,\ ist}$, from edge drop $P_3$ determined by partial model 35 downstream of the third roll stand and the actual value of edge drop $P_{3,\ ist}$ downstream of the third roll stand.

Figure 4:
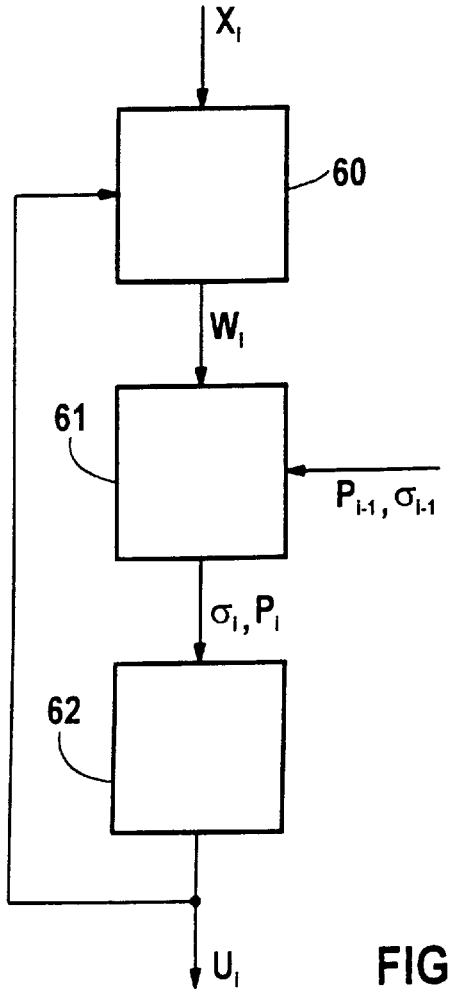
FIG. 4 shows a model of the method according to the present invention for reducing the edge drop of the rolled strip.

FIG. 4 illustrates the interaction of roll contour model 60, roll gap model 61 and an actuator 62. On the basis of process state information $X_i$ and output $U_i$ of actuator 62, roll contour model 60 calculates roll contour $W_i$ which is in turn an input variable into roll gap model 61. Further input variables into the roll gap model are edge drop $P_{i-1}$, and tension relationships $\sigma_{i-1}$ upstream of the roll stand. Output variables of roll gap model 61 are edge drop $P_i$. and tension relationships $\sigma_1$ downstream of the roll stand. On the basis of edge drop $P_i$ downstream of the roll stand, actuator 62 determines manipulated variable $U_i$.

Figure 5:
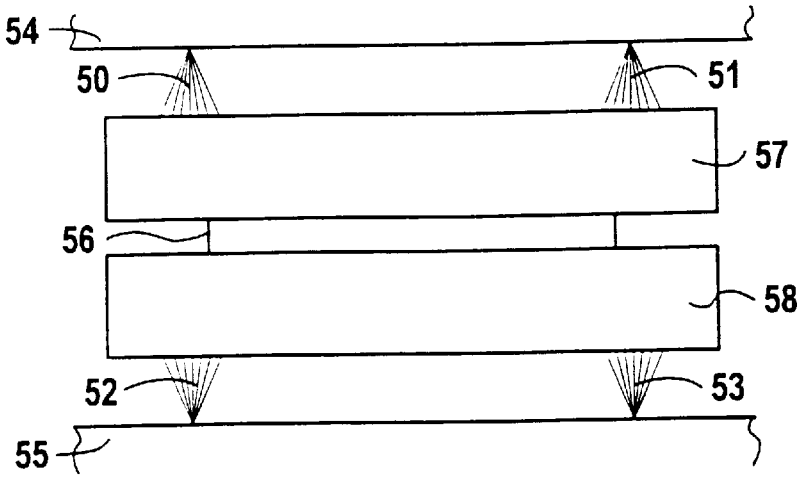
FIG. 5 shows a part of a device for reducing the edge drop of the rolled strip.

FIG. 5 shows a possible roll configuration for implementing manipulated variable $U_i$ from FIG. 4. Steel strip 56 is rolled between two operating rolls 57 and 58. Supporting and intermediate rolls are not shown in FIG. 5. In order to reduce the roll diameter at the end region of the rolled strip, which counteracts the edge drop, the system has two cooling devices 54 and 55, from which coolant 50, 51, 52, 53, advantageously water, emerges and is applied to working rolls 54 and 58. The necessary coolant quantity corresponds, for example, to variable $U_1$ of FIGS. 1 to 4.

What is claimed is:

1. A method for reducing an edge drop of a rolled strip in a roll train, the roll train including at least one roll stand, the method comprising the steps of:

controlling actuators of the at least one roll stand as a function of an edge drop of a rolled strip which exits the at least one roll stand, the actuators being controlled to reduce the edge drop;

measuring the edge drop using at least one edge drop measuring device;

determining the edge drop using a roll gap model to set the actuators at particular points of the rolled strip, the particular points being points at which the edge drop is not measured;

when the rolled strip is rolled in the roll train, adapting the roll gap model to instantaneously applicable parameters of one of the at least one roll stand and the rolled strip; and measuring the edge drop at an number of predetermined points on the rolled strip, wherein the n number is less than or equal to a number of the at least one roll stand.

2. The method according to the claim 1, wherein in the controlling step, the actuators are set as a function of a particular edge drop of a particular rolled strip which enters into the at least one roll stand.

3. The method according to the claim 1, further comprising the step of:

using the roll gap model, determining the edge drop as a function of a particular edge drop which is determined from a particular roll stand of the at least one roll stand which is positioned upstream of one of the roll stand and preceding roll stands of the at least one roll stand.

4. The method according to the claim 3, further comprising the step of:

using the roll gap model, determining the edge drop as a function of one of:

(a) the particular edge drop, (b) tension relationships of the particular rolled strip, (c) a roll contour of the particular roll stand, and (d) equivalent variables.

5. The method according to the claim 1, further comprising the step of:

measuring the edge drop at two points of the rolled strip.

6. The method according to the claim 5, further comprising the step of:

measuring the edge drop upstream of a first stand of the at least one stand and downstream of a last stand of the at least one stand.

7. The method according to the claim 5, further comprising the steps of:

with the at least one roll stand, reducing the edge drop in particular upstream roll stands of the at least one roll stand in the roll train;

measuring an edge drop upstream of a first stand of the at least one stand; and measuring an edge drop downstream of a last stand of the at least one stand.

8. The method according to the claim 3, further comprising the step of:

determining a roll contour in a roll contour model.

9. The method according to the claim 8, wherein a roll contour model includes a bending model, a temperature model and a wear model.

10. The method according to the claim 1, wherein the roll gap model models a roll stand.

11. The method according to the claim 1, further comprising the step of:

modeling a plurality of stands with the roll gap model.

12. The method according to the claim 11, wherein the at least one roll stand includes a plurality of roll stands, and the method further comprising the step of:

modeling all of the roll stands using the roll gap model.

13. The method according to the claim 1, wherein the roll gap model includes an analytical model.

14. The method according to the claim 1, wherein the roll gap model includes one of a neural network and a hybrid model, the hybrid model including a combination of the neural network and an analytical model.

15. The method according to claim 1, further comprising the step of:

deforming, using actuators, edges of the at least one roll stand with a thermal reduction procedure.

16. The method according to claim 15, further comprising the step of:

deforming, using actuators, the edges with a cooling procedure.

17. The method according to claim 1, further comprising the step of:

setting, using actuators, a roll shape at an edge of the rolled strip with tapered rolls.

18. The method according to claim 1, wherein the roll train includes a cold strip roll train.

19. The method according to claim 1, wherein the roll train includes a hot strip roll train.

20. A method for reducing an edge drop of a rolled strip in a roll train, the roll train including at least one roll stand, the method comprising the steps of:

controlling actuators of the at least one roll stand as a function of an edge drop of a rolled strip which exits the at least one roll stand, the actuators being controlled to reduce the edge drop;

measuring the edge drop using at least one edge drop measuring device;

determining values of the edge drop using a roll gap model to set the actuators at particular points of the rolled strip, the particular points being points at which the edge drop is not measured;

monitoring a tensile stress of the rolled strip;

determining at least one tensile relationship of the rolled strip using the roll gap model; and if a value of the at least one tension relationship is greater than a predetermined value, limiting a reduction of the edge drop.

21. The method according to the claim 20, wherein in the controlling step, the actuators are set as a function of a particular edge drop of a particular rolled strip which enters into the at least one roll stand.

22. The method according to the claim 20, further comprising the step of:

using the roll gap model, determining the edge drop as a function of a particular edge drop which is determined from a particular roll stand of the at least one roll stand which is positioned upstream of one of the roll stand and preceding roll stands of the at least one roll stand.

23. The method according to the claim 22, further comprising the step of:

using the roll gap model, determining the further edge drop as a function of one of:

(a) the particular edge drop, (b) tension relationships of the particular rolled strip, (c) a roll contour of the particular roll stand, and (d) equivalent variables.

24. The method according to the claim 20, further comprising the step of:

measuring the edge drop at two points of the rolled strip.

25. The method according to the claim 24, further comprising the step of:

measuring the edge drop upstream of a first stand of the at least one stand and downstream of a last stand of the at least one stand.

26. The method according to the claim 24, further comprising the steps of:

with the at least one roll stand, reducing the edge drop in particular upstream roll stands of the at least one roll stand in the roll train;

measuring an edge drop upstream of a first stand of the at least one stand; and measuring an edge drop downstream of a last stand of the at least one stand.

27. The method according to the claim 22, further comprising the step of:

determining a roll contour in a roll contour model.

28. The method according to the claim 27, wherein a roll contour model includes a bending model, a temperature model and a wear model.

29. The method according to the claim 20, wherein the roll gap model models a roll stand.

30. The method according to the claim 20, further comprising the step of:

modeling a plurality of stands with the roll gap model.

31. The method according to the claim 30, wherein the at least one roll stand includes a plurality of roll stands, and the method further comprising the step of:

modeling all of the roll stands using the roll gap model.

32. The method according to the claim 30, wherein the roll gap model includes an analytical model.

33. The method according to the claim 30, wherein the roll gap model includes one of a neural network and a hybrid model, the hybrid model including a combination of the neural network and an analytical model.

34. The method according to claim 30, further comprising the step of:

deforming, using actuators, edges of the at least one roll stand with a thermal reduction procedure.

35. The method according to claim 33, further comprising the step of:

deforming, using actuators, the edges with a cooling procedure.

36. The method according to claim 30, further comprising the step of:

setting, using actuators, a roll shape at an edge of the rolled strip with tapered rolls.

37. The method according to claim 30, wherein the roll train includes a cold strip roll train.

38. The method according to claim 30, wherein the roll train includes a hot strip roll train.

39. An arrangement for reducing an edge drop of a rolled strip in a roll train, the roll train including at least one roll stand for rolling the rolled strip, the arrangement comprising:

at least one edge drop measuring device measuring the edge drop; and a device reducing the edge drop by determining the edge drop, wherein the device, using a roll gap model, controls actuators of the at least one roll stand to reduce the edge drop at particular points of the rolled strip at which the edge drop is not measured, wherein the actuators are controlled as a function of a particular edge drop of a particular rolled strip exiting the at least one roll stand, wherein, when the rolled strip is rolled in the roll train, the roll gap model is adapted to instantaneously applicable parameters of one of the at least one roll stand and the rolled strip, and wherein the edge drop is measured at an number of predetermined points of the rolled strip, the number being less than a number of the at least one roll stand.

40. The arrangement according to claim 39, wherein the actuators are further controlled as a function of an edge drop of a second rolled strip which enters the at least one roll stand.

41. An arrangement for reducing an edge drop of a rolled strip in a roll train, the roll train including at least one roll stand for rolling the rolled strip, the arrangement comprising:

at least one edge drop measuring device measuring the edge drop; and a device reducing the edge drop by determining the edge drop, wherein the device, using a roll gap model, controls actuators of the at least one roll stand to reduce the edge drop at particular points of the rolled strip at which the edge drop is not measured, wherein the actuators are controlled as a function of a particular edge drop of a particular rolled strip exiting the at least one roll stand, wherein a tensile stress of the rolled strip is monitored, and wherein, if values of tension relationships of the rolled strip exceed a predetermined value, the actuators limit a reduction in the edge drop, the tensile relationships being determined with the roll gap model.

42. The arrangement according to claim 41, wherein the actuators are further set as a function of an edge drop of a second rolled strip which enters into the at least one roll stand.

* * * * *